US007534328B2

(12) United States Patent
Edwards et al.

(10) Patent No.: US 7,534,328 B2
(45) Date of Patent: May 19, 2009

(54) ELECTRODES USEFUL FOR MOLTEN SALT ELECTROLYSIS OF ALUMINUM OXIDE TO ALUMINUM

(75) Inventors: Leslie C. Edwards, Kingwood, TX (US); M. Franz Vogt, Kingwood, TX (US); Richard O. Love, Ravenswood, WV (US); J. Anthony Ross, Ravenswood, WV (US); William Rogers Morgan, Jr., Hawesville, KY (US)

(73) Assignees: CII Carbon LLC, Kingwood, TX (US); Century Aluminum Company, Monterey, CA (US)

( * ) Notice: Subject to any disclaimer, the term of this patent is extended or adjusted under 35 U.S.C. 154(b) by 426 days.

(21) Appl. No.: 11/540,419

(22) Filed: Sep. 29, 2006

(65) Prior Publication Data

US 2007/0068800 A1 Mar. 29, 2007

Related U.S. Application Data

(63) Continuation-in-part of application No. 10/874,508, filed on Jun. 22, 2004, now Pat. No. 7,141,149.

(51) Int. Cl.
*C25B 11/12* (2006.01)

(52) U.S. Cl. ..... 204/294; 423/445 R; 423/448; 423/460; 252/502; 252/510; 252/511; 264/29.1; 264/29.3; 264/105

(58) Field of Classification Search ..... 204/294; 423/445 R, 448, 460; 252/502, 510, 511; 264/29.1, 29.3, 105
See application file for complete search history.

(56) References Cited

U.S. PATENT DOCUMENTS 3,320,150 A * 5/1967 Metrailer ..... 204/294
3,526,684 A * 9/1970 Hutchings ..... 423/460
3,645,862 A 2/1972 Cotton et al.
3,687,431 A * 8/1972 Parks ..... 432/15
4,096,097 A * 6/1978 Yan ..... 252/510
4,173,518 A 11/1979 Yamada et al.
4,307,052 A 12/1981 Gannon et al.
4,897,170 A * 1/1990 Chandramouli ..... 204/294
5,073,611 A 12/1991 Rehmer et al.
6,380,322 B1 4/2002 Wong et al.
7,008,573 B2 * 3/2006 Ikeda et al. ..... 264/29.5
7,141,149 B2 * 11/2006 Edwards et al. ..... 204/294

OTHER PUBLICATIONS

Beck, Theodor R., "Electrolytic Production of Aluminum," Electrochemistry Encyclopedia, Oct. 2001, Electrochemical Technology Corp.

* cited by examiner

*Primary Examiner*—Bruce F Bell
(74) *Attorney, Agent, or Firm*—Walter A. Hackler

(57) ABSTRACT

The present invention provides a method of making a carbon electrode, suitable for use as an anode in an aluminum reduction cell, which comprises mixing an aggregate, comprising a mixture of particulate shot coke, and a particulate carbonaceous material other than shot coke with coal tar pitch or petroleum pitch or a combination of these pitches at an elevated temperature to form a paste wherein said aggregate comprises a combination of butts, coarse, and fine particles and said particulate shot coke may comprise a majority of said coarse particles or fine particles, and said paste comprises from about 80 to about 90%, by weight, of said aggregate and from about 10 to about 20%, by weight, of said pitch; forming said paste into a solid body; and baking said solid body at an elevated temperature to form said carbon electrode.

14 Claims, 4 Drawing Sheets

Coke Microstructures

Anisotropic - Needle Coke

Isotropic Coke

Sponge (Anode) Coke

Shot Coke

ELECTRODES USEFUL FOR MOLTEN SALT ELECTROLYSIS OF ALUMINUM OXIDE TO ALUMINUM

This patent application is a continuation-in-part of U.S. patent application Ser. No. 10/874,508, filed on Jun. 22, 2004 now U.S. Pat. No. 7,141,149 in the names of Leslie Edwards, M. Franz Vogt, Richard O. Love, J. Anthony Ross and William Morgan Jr. This application is to be incorporated herein, in toto, by this specific reference thereto.

The present invention relates to an electrode, e.g. an anode, for use in the manufacture of aluminum by molten salt electrolysis of aluminum oxide, e.g. in an aluminum reduction cell. More particularly, it relates to a process for manufacturing an anode for use in aluminum reduction cells.

It has been known to manufacture aluminum by molten salt electrolysis of aluminum oxide dissolved in a bath of the fluorides of aluminum and sodium, or cryolite, using a carbon anode. Usually, such an electrolysis process is conducted at about 900° to 1000° Centigrade. In this process, the carbon anode is consumed by oxidation due to the oxygen produced by the decomposition of aluminum oxide to the aluminum metal.

In commercial anode production processes, calcined sponge petroleum cokes or coal tar pitch cokes, along with recycled carbon anode remnants or butts, are used to provide an aggregate which is then separated into different size fractions. Typically, there can be anywhere between 3-6 different size fractions. A common approach is to separate the aggregate into three fractions: a "butts" fraction, "coarse" fraction and "fines" fraction. The different size fractions are then recombined in fixed proportions and mixed with a binder such as coal tar pitch or a combination of coal tar and petroleum pitches (combination pitch) and subsequently shaped and heated at an elevated temperature, e.g. about 1100° C., to form the commercial anode. The manufacture of such commercial anodes requires a coke that has low volatile matter, vanadium and nickel under 500 ppm and sulfur under 4%, by weight, and preferably under 3%, by weight. In addition, to having relatively low impurities, the cokes used in commercial anode production, are somewhat anisotropic in structure. Such coke is preferably calcined, sponge coke. In contrast to anisotropic cokes, isotropic cokes are cokes with a very fine-grained structure or texture which exhibit similar properties in all directions. That is, anisotropic cokes have a coarser texture and the properties are directionally dependent. The extreme example of anisotropic coke is needle coke which has an elongated or ribbon like structure. Delayed sponge coke used for making anodes has a heterogeneous structure with a mixture of isotropic and anisotropic structures.

Shot coke is a form of isotropic coke with a very unique structure. It has a fine texture with uniform directional properties, and the particles tend to be more spherical in shape and more uniform in size. Shot coke typically also has lower macro-porosity (porosity >1 μm) and higher micro-porosity (<1 μm) than delayed sponge cokes used to make anodes.

There is a large supply of isotropic and shot coke materials in the world, and they are generally significantly lower in price than traditional anode grade green cokes. The impurity levels are typically higher than anode grade cokes, particularly impurities like sulfur, vanadium and nickel and this is the primary driver of their lower cost.

The aluminum industry has avoided using isotopic cokes, particularly shot cokes, to make anodes because they have high coefficients of thermal expansion (CTE). Anodes made with these materials can crack catastrophically during the rapid heat-up that occurs in aluminum electrolysis cells. This creates a hazardous and costly outcome for the aluminum plant or smelter.

As a result, shot coke, with its higher impurity levels, more isotropic structure and higher thermal expansion coefficient when calcined, has never been successfully used for such commercial anodes.

In particular, carbon anodes, made from an aggregate comprising more than 5% by weight of shot coke, exhibit a propensity for thermal shock cracking due to the high coefficient of thermal expansion and the anode strength is weakened due to the difficulty in binding shot coke particles with coal tar or combination pitch. Thus, the anode scrap rates from anodes prepared from shot coke are unacceptably high and anode carbon loss in the aluminum reduction cells creates a serious and unacceptable disruption to the smelting process.

When discussing petroleum coke, it is essential to recognize that there are three different types of coking processes and the petroleum coke produced from each is distinctly different. These processes—delayed, fluid and flexicoking—are all effective in converting heavy hydrocarbon oil fractions to higher value, lighter hydrocarbon gas and liquid fractions and concentrating the contaminants (sulfur, metals, etc.) in the solid coke.

Petroleum coke from the delayed process is described as delayed sponge, shot or needle coke depending on its physical structure. Shot is most prevalent when running the unit under severe conditions with very heavy crude oil residuum containing a high proportion, of asphaltenes. Needle coke is produced from selected aromatic feedstocks. Although the chemical properties are most critical, the physical characteristics of each coke type play a major role in the final application of the coke. For example, sponge coke has a relatively high macro-porosity and the pores are evident from visual examination of the coke. If the quality is acceptable, it may be sold to the calcining industry as a raw material for anode coke production where it has a higher value. Shot coke looks like BB's, has a lower macro-porosity and is harder; it is almost always sold as a fuel coke for a relatively low value. Needle coke's unique structure lends to its use for graphitized electrodes. Unlike the others, needle coke is a product (not a by-product) which the refinery intentionally produces from selected hydrocarbon feedstocks.

Shot coke is characterized by small round spheres of coke, the size of BB's, loosely bound together. Occasionally, they agglomerate into ostrich egg sized pieces. While shot coke may look like it is entirely made up of shot, most shot coke is not 100% shot. Interestingly, even sponge coke may have some measurement of embedded shot coke. A low shot coke percentage in petroleum coke is preferably specified for anode grades of petroleum coke.

Shot coke, while useful as a fuel, is less valuable than sponge coke which can be used to prepare the more valuable carbon anodes. It is therefore desirable to find a way to use the less valuable shot coke in an application having a greater value, i.e. to manufacture carbon anodes, provided said carbon anodes do not have poor quality.

SUMMARY OF THE INVENTION

Preferably, in accordance with the present invention, the aggregate comprises more than 5%, by weight, of shot coke, and may comprise up to 90%, by weight, of shot coke, but preferably the anodes of this invention will comprise up to about 50%, e.g. from about 15% to about 50% shot coke. The shot coke, is preferably calcined to remove most of the volatiles prior to use in the method of the invention.

The calcined shot coke, may be screened and milled to provide particles in the correct size ranges. For the purposes of the present invention, fine particles are defined as those whereby 100% will pass through a 60 mesh, Tyler Sieve Size and approximately 70% or more will pass through a 200 mesh U.S. Standard Sieve Size.

The milling process to obtain the above fine particles is common knowledge in the art and need not be disclosed herein.

The particulate shot coke, may have a sulfur content of up to 8%, by weight. It is generally undesirable for the coke utilized in the manufacture of carbon electrodes for use in an aluminum reduction cell to have a sulfur content of greater than about 4%.

The remainder of the aggregate may comprise any particulate carbonaceous material that is suitable for preparing carbon electrodes, including recycled anode butts, for use in aluminum reduction cells. Such carbonaceous materials are well known in the art.

Preferably, said carbonaceous material is selected from the group consisting of sponge, needle or pitch cokes, and recycled carbon electrode remnants.

It has now been discovered that a satisfactory carbon electrode, suitable for use in an aluminum reduction cell may be prepared from a particulate carbonaceous, aggregate, preferably comprising more than about 5%, by weight, of a shot coke, and more preferably said aggregate comprises from 5% to about 50%, by weight, of a shot coke.

Thus, the present invention provides a method of making a carbon electrode, suitable for use as an anode in an aluminum reduction cell, which comprises separating an aggregate into different size fractions by a combination of crushing, milling and screening whereby such an aggregate may comprise a mixture of a particulate shot coke, recycled anode butts, and a particulate carbonaceous material other than shot coke, with coal tar pitch or combination pitch at an elevated temperature to form a paste wherein said aggregate comprises a combination of butts, coarse, and fine particles and said paste comprises up to about 90%, e.g. about 85%, by weight, of said aggregate and from about 10 to about 20%, e.g. 15%, by weight, of said coal tar pitch or combination pitch; forming said paste into a solid body; and baking said solid body at an elevated temperature to form said carbon electrode.

Furthermore, it has now been discovered that in the process of preparing electrodes of this invention, the properties of the electrode can be influenced significantly by selecting the size of the shot coke used in the aggregate. For example, if the shot coke is added to the coarse fraction of the aggregate, the anode density can be improved but the coefficient of thermal expansion will be negatively affected (higher). The anode air reactivity on the other hand, will not be significantly affected when shot coke, is added to the coarse fraction of the aggregate.

When shot coke is milled and added to the fines fraction, the coefficient of thermal expansion will not be significantly affected but no improvement in anode density will occur. The anode air reactivity on the other hand, will be negatively affected (increase) when the shot coke is added to the fines fraction of the aggregate.

BRIEF DESCRIPTION OF THE DRAWINGS

This invention will be more readily understood by reference to the drawings.

FIG. 1 shows the change in air reactivity with the percentage of shot coke in the aggregate that was used to form the carbon anode of this invention;

FIG. 2 shows the change in the coefficient of thermal expansion with the percentage of shot coke in the aggregate that was used to form the carbon anode;

FIG. 3 shows the change in the $CO_2$ reactivity residue with the percentage of shot coke in the aggregate that was used to form the carbon anode of this invention;

FIG. 4 shows the change in the baked apparent density with the percentage of shot coke in the aggregate that was used to form the carbon anode of this invention;

DETAILED DESCRIPTION

Figure 1:
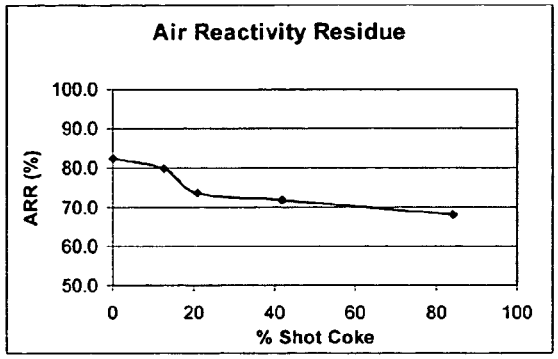
FIGS. 1-4 refer to experiments where shot coke was added to all aggregate fractions in the anode at different levels, more particularly.

In the method of the invention, the above described aggregate is combined with a coal tar pitch binder or a combination pitch binder.

Coal tar pitch is a residue produced by distillation or heat treatment of coal tar. It is a solid at room temperature, consists of a complex mixture of numerous predominantly aromatic hydrocarbons and heterocyclics, and exhibits a broad softening range instead of a defined melting temperature. Petroleum pitch is a residue from heat treatment and distillation of petroleum fractions. It is solid at room temperature, consists of a complex mixture of numerous predominantly aromatic and alkyl-substituted aromatic hydrocarbons, and exhibits a broad softening range instead of a defined melting temperature. Combination pitch is a mixture or combination of coal tar pitch and petroleum pitch.

The hydrogen aromaticity in coal tar pitch (ratio of aromatic to total content of hydrogen atoms) varies from 0.7 to 0.9. The hydrogen aromaticity (ratio of aromatic to total hydrogen atoms) varies between 0.3 and 0.6. The aliphatic hydrogen atoms are typically present in alkyl groups substituted on aromatic rings or as naphthenic hydrogen.

The aggregate utilized in the method of the present invention comprises a mixture of fine, coarse and recycled anode butts particles. The mesh sizes for the fine particles are defined above. Coarse particles, which may also contain recycled anode butts, will be retained on a 16 mesh Tyler screen.

The aggregate is combined and mixed with the coal tar pitch or combination pitch. There are numerous mixing schemes in the art. Any of them may be adapted for use in the method of this invention, simply by treating the shot coke-containing aggregate in the same way as the current aggregate is combined with the pitch.

It is important that the aggregate and the pitch are mixed together at an elevated temperature, e.g. greater than 150° C., in order to coat the particles with pitch, penetrate the pitch and the fine particles into the internal pores of the coarse particles and fill the interstitial aggregate volume with the pitch and the fine particles.

After mixing the aggregate and the coal tar pitch for 1 to 45 minutes, e.g. from 5 to 20 minutes, a paste is formed.

The paste may be formed into a solid body, by methods known in the art, e.g. pressing or vibroforming, prior to baking to form the electrode.

The green electrode is baked at an elevated temperature to provide a carbon electrode suitable for use in an aluminum reduction cell. Preferably, the green electrode is baked at a temperature of from 1000° C. to 1200° C., e.g. about 1100° Centigrade for a time sufficient for the green electrode to reach a temperature within the preferred range.

The baking may take place in open or closed furnaces, as is well known in the art.

The method of the invention provides carbon electrodes having characteristics including density, air permeability, compressive strength, modulus of elasticity, thermal conductivity, coefficient of thermal expansion, air reactivity, and carboxy-reactivity which are within acceptable ranges, for use in aluminum smelters.

In another aspect of the present invention, there is provided a carbon electrode, suitable for use an anode in an aluminum reduction cell, which comprises (a) an aggregate comprising a mixture of particulate shot coke, and a particulate carbonaceous material other than said shot coke, and (b) a coal tar or combination pitch binder, wherein said aggregate comprises a combination of coarse and fine particles and said particulate shot coke, comprises a majority of said coarse particulates.

In said electrode, preferably said aggregate is prepared by screening and/or milling shot coke, and a carbonaceous material other than said shot coke from a delayed coker to provide a particulate mixture comprising at least 5%, preferably about 30 to 40 percent by weight.

To this screened and/or milled aggregate may be added from about 5 to about 20 percent, e.g. about 15% butts. Thus, the aggregate utilized in the method of preparing the anodes of the invention may comprise from 5 to 60 percent, preferably about 50% coarse, from 10 to 50 percent, preferably about 34% fine, and from 0 to 25% preferably, 16% buttsAlso, in said preferred aggregate the shot coke may vary from 10 to 85.0, by weight, of the aggregate. .

Preferably the particulate carbonaceous material in the electrode is selected from the group consisting of sponge, needle or pitch cokes, and recycled carbon electrode remnants.

In this aspect of the present invention, the fines may comprise shot coke, e.g., milled shot coke, or some other particulate carbonaceous material, e.g., fine particulates from the delayed coking of heavy hydrocarbon oil fractions.

Any of the above, novel electrodes or electrodes made by the method of the present invention may be used in a method for producing aluminum by the molten salt electrolysis of aluminum oxide which comprises electrolyzing aluminum oxide dissolved in a molten salt at an elevated temperature by passing a direct current through an anode to a cathode disposed in said molten salt wherein said anode is any of the above electrodes.

The cokes utilized in the following examples have the properties shown in Table 1, below.

TABLE 1

| Coke | Ni % | FE % | V % | S % | AD g/cc | KVBD g/cc | RD g/cc | SR Ohm-in | CO2 Reac. % | Air Reac. % per min. |
|---|---|---|---|---|---|---|---|---|---|---|
| A | 0.016 | 0.023 | 0.023 | 2.58 | 1.76 | 0.796 | 2.073 | 0.038 | 7.3 | 0.10 |
| B | 0.032 | 0.023 | 0.067 | 4.53 | 1.80 | 1.111 | 2.042 | 0.042 | 4.3 | 0.36 |

Coke A is a regular delayed anode coke blend; and coke B is a shot coke with a high percentage of BB's.

The characteristics of shot cokes are as follows:

The shot cokes are significantly higher in Ni, V and S.

The shot coke has a significantly higher vibrated bulk density (KVBD) and apparent density (AD).

The real density (RD) of the shot coke was significantly lower and a specific electrical resistivity significantly higher.

The air reactivity of the shot coke and isotropic coke is higher.

EXAMPLE 1

In this example, shot coke was added to two of the aggregate size fractions—coarse and fines. Control anodes using 100% regular delayed anode coke were prepared for comparison.

A total of 5 different anode formulations were prepared at 3 different pitch levels (15.5, 16.0, and 16.5%) to give a total of 15 anodes. The mixer batch size was 9 kg. Forming was done via a laboratory hydraulic press and the anodes were baked in lab mode baking furnace. The fines fraction was prepared using a laboratory ring and puck mill. A standard aggregate granulometry containing 50% coarse, 34% fines and 16% butts was used for all anodes.

Table 2 below, shows the different recipes tested in this Example 1. The control anodes are laboratory versions of anodes that are used in commercial applications.

TABLE 2

| Anode Series Code | Coke Recipe | % Shot Coke in Aggregate |
|---|---|---|
| S1 | 15% Shot/85% Regular Coke | 12.5 |
| S2 | 25% Shot/75% Regular Coke | 21.0 |
| S3 | 50% Shot/50% Regular Coke | 42.0 |

TABLE 2-continued

| Anode Series Code | Coke Recipe | % Shot Coke in Aggregate |
|---|---|---|
| S4 | 100% Shot Coke | 84.0 |
| C | 100% Regular Coke | 0 |

Figure 2:
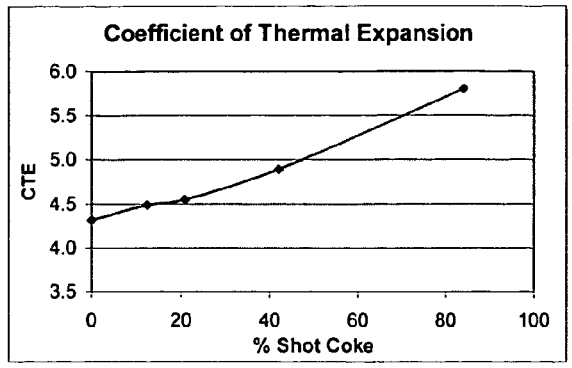
Figure 3:
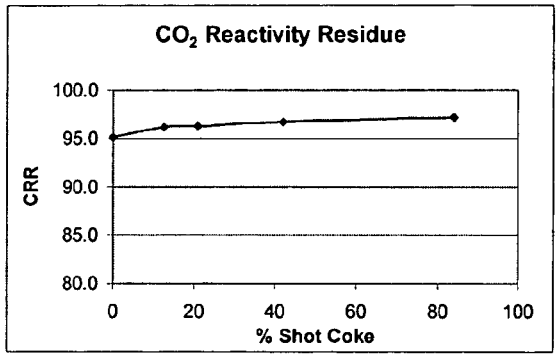
Figure 4:
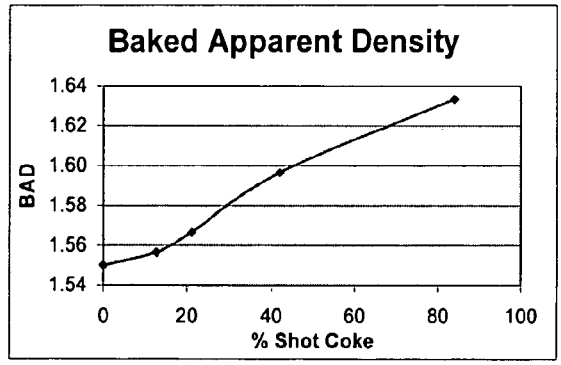
Figure 5:
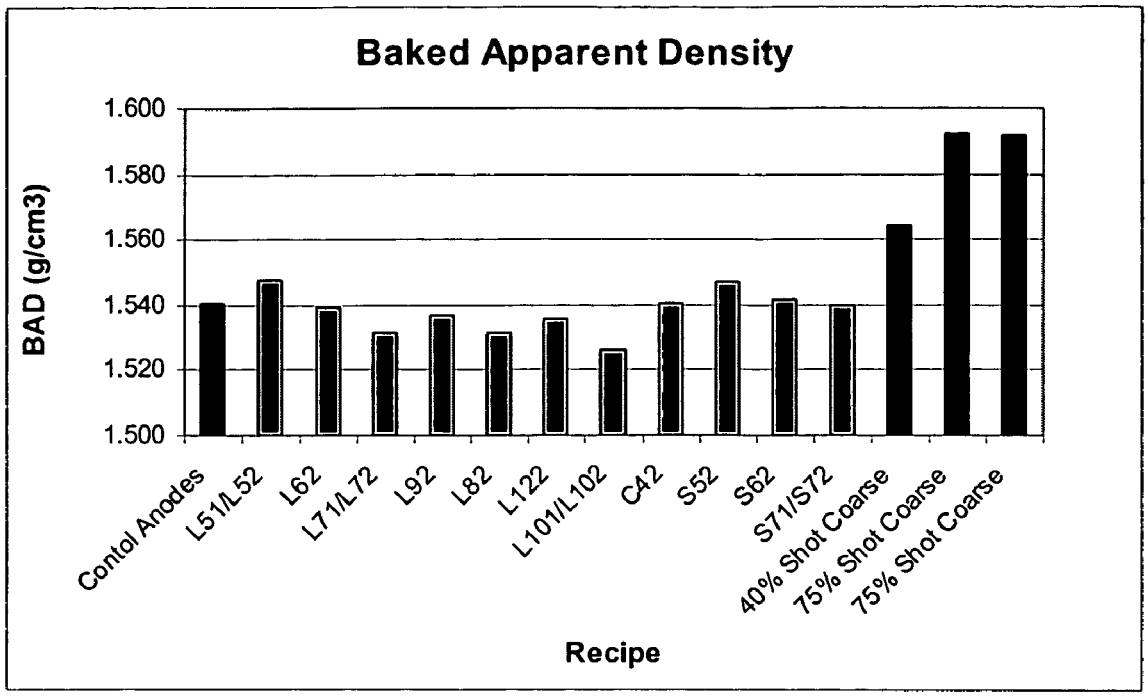
FIG. 5 shows the variation of baked apparent density when shot coke was added selectively to the coarse or fines fraction.
Figure 6:
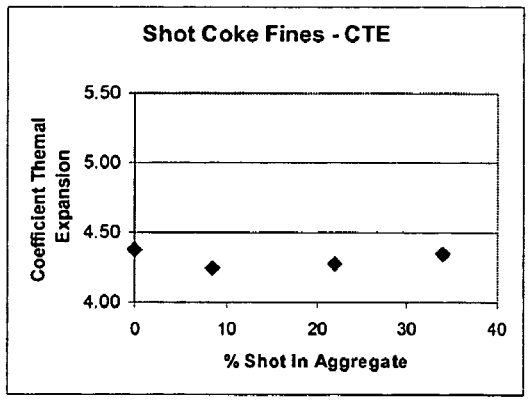
FIGS. 6 and 7 compare the coefficient of thermal expansion wherein the shot coke is added selectively to the fines or coarse fraction of the aggregate that is used to prepare the carbon anodes of this invention.
Figure 7:
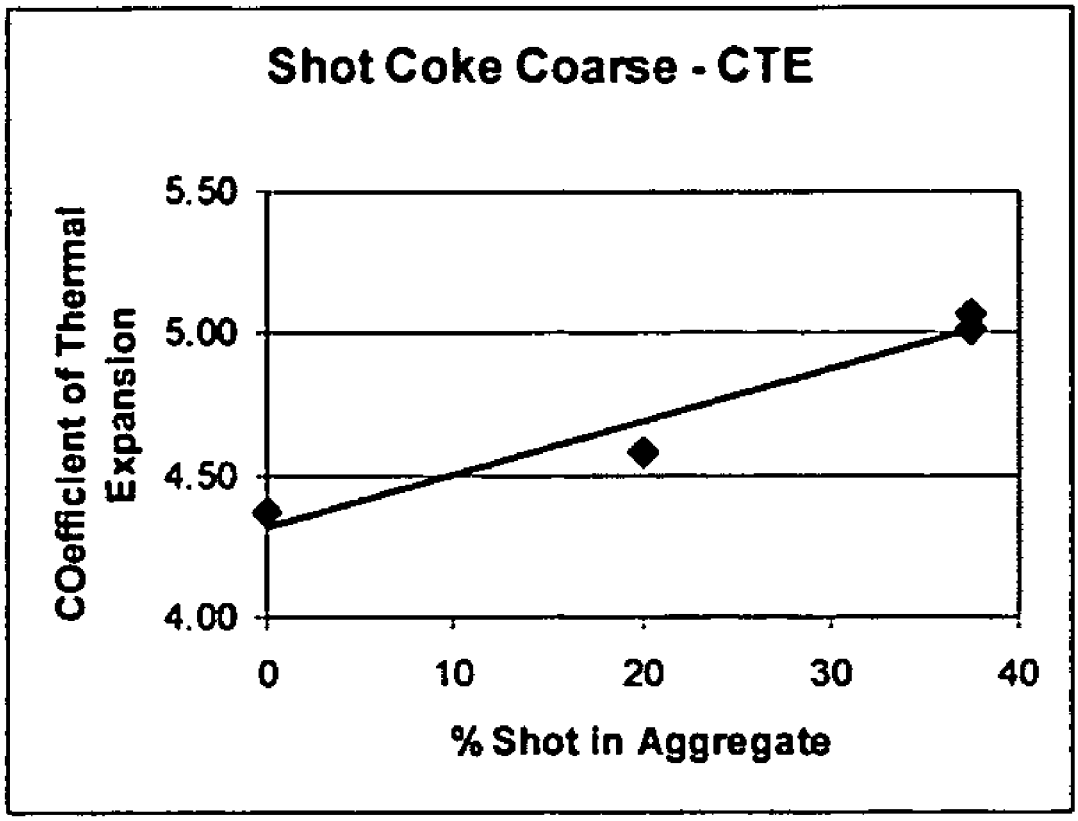
Figure 8:
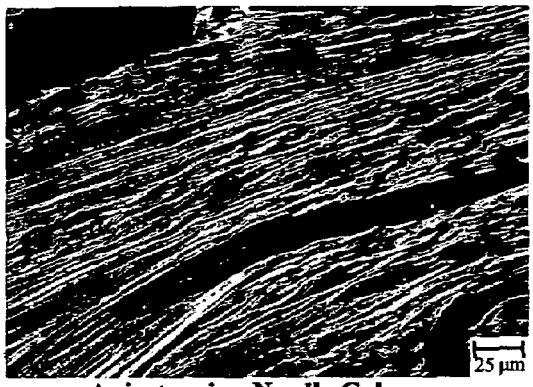
FIG. 8 shows the structure of anisotropic cokes, e.g. needle coke and sponge coke, and isotropic cokes, e.g. shot cokes.
Figure 8:
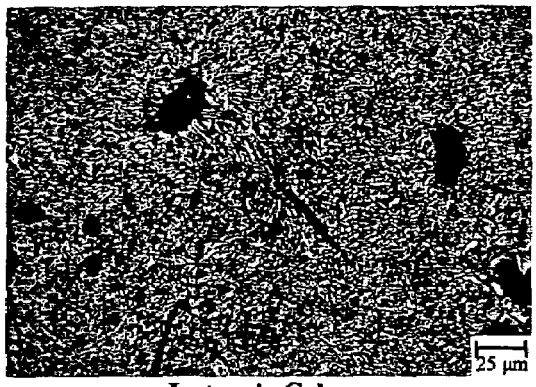
Figure 8:
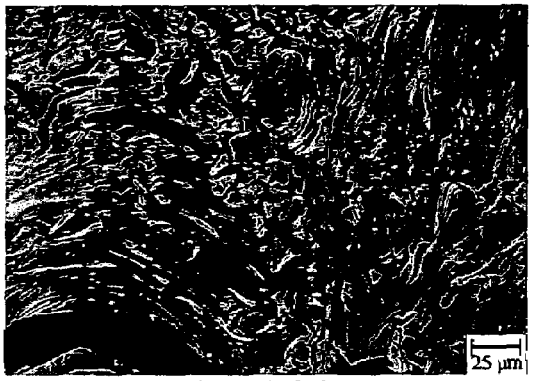
Figure 8:
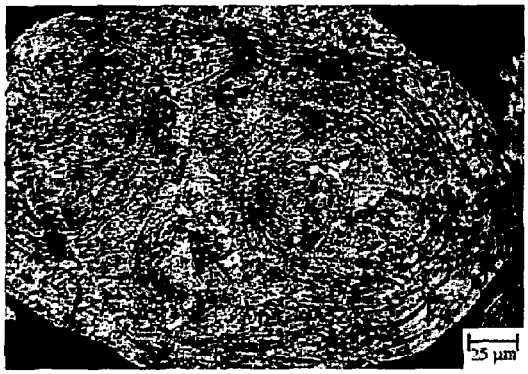

The results are summarized below and in FIGS. 1 and 2. As shown:

- Anode air reactivities deteriorated as the percentage of isotropic coke and shot coke increased.
- Anode coefficients of thermal expansion, or CTE's, increased as the percentage of isotropic and shot coke increased.
- Anode densities increased as the percentage of shot coke increased.
- With up to 50% shot coke in the coke recipe, most other anode properties were comparable to the control anodes.

Property data for all the lab anodes produced in this experiment is included in Table 3, below.

different mixer batches. Six lab anodes were produced from each mixer batch giving a total of one hundred eighty laboratory anodes. The different formulations tested are shown in Table 2 below.

TABLE 4

| ANODE CODE | DESCRIPTION | PITCH | FORMING |
|---|---|---|---|
| C41/C42 | 100% Regular | CT | Vibrate |
| C51/C52 | 100% Regular | CT | Press |
| S51/S52 | 25% Shot in Fines Fraction | CT | Vibrate |
| S61/S62 | 65% shot in Fines Fraction | CT | Vibrate |
| S71/S72 | 100% Shot in Fines Fraction | CT | Vibrate |
| S81/S82 | 40% Shot in Coarse Fraction | CT | Vibrate |
| S91/S92 | 75% Shot in Coarse Fraction | CT | Vibrate |
| S101/S102 | 75% Shot in Coarse Fraction | A | Vibrate |

CT refers to coal tar pitch and A refers to Type A pitch.

The baked anodes were tested for density, electrical resistivity, air permeability, crush strength, flexural strength, modulus of elasticity, fracture energy, CTE, thermal conductivity, air reactivity residue and $CO_2$ reactivity residue. Results were averaged and grouped together, where possible, to determine general trends.

TABLE 3

| Lab Code | Shot % | Pitch % | Green Density | Koppers BAD | TC W/mK | AD g/cc | ER □Oms-m | CO2 % Residue | CO2 % Dust | CO2 % Loss | Air % Residue | Air % Dust | Air % Loss | AP nPm | Flex MPa | CTE E * 10^-6 |
|---|---|---|---|---|---|---|---|---|---|---|---|---|---|---|---|---|
| S11 | 15 | 14.5 | 1.603 | 1.561 | 2.46 | 1.55 | 87.9 | 96.00 | 0.11 | 3.89 | 76.2 | 7.7 | 16.1 | 2.40 | 3.8 | 4.540 |
| S12 | 15 | 15.0 | 1.616 | 1.566 | 2.41 | 1.55 | 89.9 | 95.98 | 0.16 | 3.86 | 85.3 | 7.6 | 16.9 | 2.23 | 3.5 | 4.606 |
| S13 | 15 | 15.5 | 1.633 | 1.581 | 2.44 | 1.57 | 85.0 | 96.70 | 0.11 | 3.19 | 78.0 | 6.5 | 15.6 | 2.60 | 4.0 | 4.314 |
| S21 | 25 | 14.5 | 1.618 | 1.576 | 2.16 | 1.56 | 92.9 | 95.71 | 0.22 | 4.07 | 74.0 | 8.3 | 17.7 | 2.60 | 3.7 | 4.604 |
| S22 | 25 | 15.0 | 1.630 | 1.582 | 2.31 | 1.57 | 85.0 | 96.34 | 0.11 | 3.55 | 72.0 | 8.8 | 19.2 | 2.45 | 4.3 | 4.484 |
| S23 | 25 | 15.5 | 1.642 | 1.584 | 2.57 | 1.57 | 81.9 | 96.68 | 0.11 | 3.21 | 74.8 | 7.4 | 17.8 | 2.75 | 5.2 | 4.556 |
| S31 | 50 | 14.5 | 1.651 | 1.600 | 2.54 | 1.59 | 84.5 | 96.61 | 0.16 | 3.23 | 70.9 | 7.1 | 22.0 | 2.63 | 4.6 | 4.777 |
| S32 | 50 | 15.0 | 1.661 | 1.615 | 2.55 | 1.60 | 76.3 | 96.94 | 0.11 | 2.95 | 70.3 | 7.7 | 22.0 | 2.30 | 5.6 | 5.012 |
| S33 | 50 | 15.5 | 1.666 | 1.619 | 2.6 | 1.60 | 70.5 | 96.69 | 0.11 | 3.21 | 74.0 | 5.6 | 20.4 | 1.82 | 5.7 | 4.897 |
| S41 | 100 | 14.5 | 1.701 | 1.657 | 2.71 | 1.64 | 58.4 | 97.60 | 0.05 | 2.35 | 67.2 | 5.1 | 27.7 | 2.04 | 7.7 | 5.903 |
| S42 | 100 | 15.0 | 1.699 | 1.655 | 1.67 | 1.63 | 55.2 | 97.37 | 0.10 | 2.52 | 69.3 | 3.5 | 27.2 | 4.05 | 9.3 | 5.622 |
| S43 | 100 | 15.5 | 1.707 | 1.649 | 3.01 | 1.63 | 58.0 | 96.60 | 0.10 | 3.30 | 67.5 | 4.7 | 27.8 | 5.42 | 9.5 | 5.895 |
| C1 | 0 | 15.5 | | 1.598 | 2.48 | 1.54 | 72 | 95.57 | 0.11 | 4.32 | 80.5 | 5 | 14.5 | 2.42 | 5.3 | 4.299 |
| C2 | 0 | 16.0 | | 1.605 | 2.31 | 1.55 | 75.7 | 94.05 | 0.33 | 5.62 | 82.6 | 4.4 | 13.1 | 1.57 | 6.6 | 4.454 |
| C3 | 0 | 16.5 | | 1.609 | 2.34 | 1.55 | 76.2 | 95.77 | 0.05 | 4.17 | 84.5 | 3 | 12.5 | 1.63 | 5.8 | 4.209 |

EXAMPLE 2

In the experiments described in this Example 2, the shot coke was concentrated in different fractions of the aggregate. It was expected that it would be advantageous to grind the shot coke and concentrate it in the fines fraction to minimize the negative effects on CTE. Two different types of pitch were also tested in this set of experiments—regular coal tar pitch and a coal tar/petroleum pitch blend.

The anodes of this experiment were produced in a larger mixer batch size (17 kg/mix) and a lab scale vibroformer instead of a hydraulic press was utilized. The anode baking furnace was also larger, allowing up to 30 anodes to be baked at one time. The quantity of fines required was too large to produce in a laboratory ring and puck mill so a 70 kg/hr ball mill was used. The particle size distribution was monitored closely to make sure it matched the size distribution of the ball mill utilized in commercial production of carbon anodes for aluminum smelting.

Fifteen different anode formulations were tested in Example 2 at two different pitch levels giving a total of thirty The experiments of this Example 2 showed some unexpectedly good results. A summary of key results is given below. More detailed results are included in Table 5.

- Shot coke added to the fines fraction had no effect on density but when added to the coarse fraction, the density increased significantly.
- shot coke additions to the fines fraction caused a progressive deterioration in anode air reactivity. Anode CTE's and other mechanical properties were unaffected.
- Air reactivities deteriorated only slightly when shot coke was added to the coarse fraction.
- Anode CTE's increased almost linearly as shot coke was added to the coarse fraction. Anode strengths also decreased.
- Anode $CO_2$ reactivities were good for all formulations tested with shot coke.

TABLE 5

| Anode Code | Recipe | Pitch Type | Pitch Level | GAD | Stdev | Shrink (%) | Stdev | BAD | Stdev | ER | Stdev | Air Perm | Stdev | Crush | StDev |
|---|---|---|---|---|---|---|---|---|---|---|---|---|---|---|---|
| S51 | 25% S Fines | CT | Lo | 1.542 | 0.012 | 1.34 | 0.39 | 1.534 | 0.006 | 76.1 | 3.5 | 2.83 | 1.34 | 35.5 | 0.2 |
| S52 | 25% S Fines | CT | Hi | 1.584 | 0.008 | 1.06 | 0.15 | 1.547 | 0.003 | 63.8 | 1.3 | 0.82 | 0.02 | 38.0 | 1.2 |
| S61 | 65% S Fines | CT | Lo | 1.533 | 0.006 | 1.32 | 0.07 | 1.512 | 0.011 | 74.5 | 3.8 | 4.24 | 1.45 | 32.6 | 0.5 |
| S62 | 65% S Fines | CT | Hi | 1.567 | 0.011 | 0.93 | 0.16 | 1.542 | 0.008 | 66.1 | 2.1 | 1.49 | 0.82 | 33.9 | 0.2 |
| S71 | 100% S Fines | CT | Lo | 1.555 | 0.008 | 1.28 | 0.14 | 1.539 | 0.004 | 70.0 | 0.7 | 1.57 | 0.26 | 39.3 | 1.2 |
| S72 | 100% S Fines | CT | Hi | 1.589 | 0.006 | 0.85 | 0.14 | 1.541 | 0.002 | 66.0 | 0.9 | 1.11 | 0.05 | 37.1 | 0.2 |
| S81 | 40% S Coarse | CT | Lo | 1.554 | 0.004 | 1.24 | 0.13 | 1.529 | 0.003 | 85.2 | 1.7 | 4.80 | 0.61 | 30.5 | 1.5 |
| S82 | 40% S Coarse | CT | Hi | 1.601 | 0.008 | 1.00 | 0.08 | 1.564 | 0.004 | 64.7 | 1.4 | 1.02 | 0.35 | 38.9 | 1.3 |
| S91 | 75% S Coarse | CT | Lo | 1.621 | 0.004 | 1.41 | 0.08 | 1.591 | 0.004 | 66.8 | 2.1 | 0.85 | 0.14 | 39.3 | 2.0 |
| S92 | 75% S Coarse | CT | Hi | 1.646 | 0.020 | 0.76 | 0.12 | 1.593 | 0.012 | 59.9 | 1.4 | 0.50 | 0.06 | 38.9 | 4.0 |
| S101 | 75% S Coarse | A | Lo | 1.629 | 0.005 | 0.96 | 0.14 | 1.588 | 0.003 | 65.5 | 1.5 | 1.51 | 0.80 | 40.9 | 0.2 |
| S102 | 75% S Coarse | A | Hi | 1.654 | 0.006 | 0.80 | 0.10 | 1.596 | 0.002 | 67.6 | 0.7 | 0.52 | 0.08 | 37.8 | 1.7 |
| C41 | Control | CT | Lo | 1.537 | 0.008 | 1.16 | 0.11 | 1.514 | 0.007 | 74.1 | 3.0 | 4.05 | 2.73 | 32.7 | 1.7 |
| C42 | Control | CT | Hi | 1.588 | 0.007 | 0.95 | 0.09 | 1.541 | 0.004 | 62.0 | 1.9 | 0.68 | 0.14 | 34.5 | 0.8 |

| Anode Code | Recipe | MOE | Stdev | Flex | Stdev | Frac E | Stdev | CTE | Stdev | TC | Stdev | ARR | Stdev | CO2 | Stdev |
|---|---|---|---|---|---|---|---|---|---|---|---|---|---|---|---|
| S51 | 25% S Fines | 1693.1 | 202.6 | 2.6 | 0.1 | 113.5 | 55.4 | 4.31 | 0.12 | 2.58 | 0.00 | 85.2 | 5.2 | 97.3 | 0.2 |
| S52 | 25% S Fines | 2191.7 | 127.3 | 4.8 | 0.2 | 157.6 | 16.7 | 4.25 | 0.04 | 2.70 | 0.12 | 83.3 | 1.5 | 97.3 | 0.3 |
| S61 | 65% S Fines | 1619.8 | 25.2 | 3.5 | 0.1 | 164.3 | 32.8 | 4.41 | 0.16 | 2.51 | 0.04 | 83.0 | 3.2 | 96.7 | 0.5 |
| S62 | 65% S Fines | 1827.3 | 108.3 | 4.7 | 0.5 | 184.4 | 7.9 | 4.28 | 0.04 | 2.56 | 0.09 | 80.2 | 8.0 | 97.4 | 0.2 |
| S71 | 100% S Fines | 2029.5 | 41.3 | 5.3 | 0.6 | 106.5 | 51.1 | 4.34 | 0.07 | 2.60 | 0.07 | 70.4 | 1.5 | 97.2 | 0.2 |
| S72 | 100% S Fines | 1834.4 | 352.0 | 6.6 | 1.0 | 132.1 | 59.5 | 4.36 | 0.14 | 2.67 | 0.22 | 74.5 | 1.4 | 97.6 | 0.3 |
| S81 | 40% S Coarse | 1511.5 | 233.2 | 1.6 | 0.2 | 59.6 | 5.4 | 4.59 | 0.16 | 2.31 | 0.06 | 92.2 | 1.7 | 95.6 | 1.5 |
| S82 | 40% S Coarse | 2265.6 | 168.9 | 3.6 | 0.3 | 94.3 | 27.1 | 4.58 | 0.01 | 2.78 | 0.05 | 89.1 | 2.9 | 94.8 | 1.8 |
| S91 | 75% S Coarse | 2007.0 | 187.5 | 3.3 | 0.0 | 120.9 | 1.0 | 4.94 | 0.09 | 2.70 | 0.02 | 88.1 | 0.5 | 96.2 | 1.0 |
| S92 | 75% S Coarse | 2193.5 | 37.7 | 6.7 | 1.9 | 144.3 | 73.9 | 5.19 | 0.11 | 2.97 | 0.24 | 87.9 | 1.3 | 95.6 | 1.0 |
| S101 | 75% S Coarse | 2292.9 | 269.2 | 4.3 | 0.8 | 248.1 | 0.5 | 5.09 | 0.15 | 2.72 | 0.03 | 84.2 | 2.7 | 97.7 | 0.0 |
| S102 | 75% S Coarse | 1945.2 | 40.4 | 3.4 | 0.5 | 244.6 | 2.7 | 4.94 | 0.10 | 2.62 | 0.06 | 82.0 | 0.1 | 96.6 | 0.9 |
| C41 | Control | 1506.2 | 151.6 | 3.2 | 0.1 | 77.6 | 27.5 | 4.21 | 0.04 | 2.52 | 0.04 | 91.9 | 1.0 | 96.8 | 0.6 |
| C42 | Control | 2171.2 | 62.7 | 6.4 | 0.1 | 203.7 | 34.7 | 4.37 | 0.02 | 2.73 | 0.01 | 93.0 | 0.4 | 96.7 | 0.3 |

The results in this Example 2 show that anode properties of the carbon anodes of this invention as prepared with the addition of shot are dependent on how the shot coke is added. CTE's do not increase when the coke is added to the fines fraction but anode air reactivities deteriorate. When shot cokes are added to the coarse fraction, the CTE's increase significantly but anode air reactivities are not as significantly affected. In addition, there is a major advantage of adding shot coke to the coarse fraction, that is an increased anode density is obtained.

Thus, the anodes prepared according to Example 2 where shot coke is selectively added to the coarse fraction, are especially useful in a smelter which uses relatively small anodes at lower currents (<150,000 Amps), because, such cells are not as susceptible to thermal shock cracking as larger anodes in higher current cells. The design of such cells is typically quite sensitive to anode airburn, however, due to the difficulty in being able to keep the anodes well covered. As a result, any addition of shot coke to the fines fraction will exacerbate anode airburn and negatively affect cell performance.

EXAMPLE 3

Based on the results of Example 2, it was decided that the density gains possible by adding shot coke to the coarse fraction warranted additional optimization work.

In this experiment, the fines content and pitch level of shot coke added to the coarse fraction was optimized. A single shot coke level was selected on the basis of the calculated anode sulfur level. At high shot coke addition rates, anode sulfur levels increase to the point where the smelter would exceed its $SO_2$emissions limit. The goal was to keep the aggregate sulfur level under 3%. To stay within this range, shot coke additions were limited to 40% of the coarse fraction which equated to 20% of the total aggregate (including butts).

The fines content was optimized first by preparing dry aggregate mixes gave at different fines levels and measuring the vibrated bulk density. A fines content of 27% yields optimum results.

Pitch optimization tests were carried out at two different butts levels (16% & 18%). Lab anodes were baked and tested and a formulation was selected for a plant trial. The main objective of the plant trial was to see if full size plant anodes could be produced with 20% shot coke without production problems. It was unknown for example, how these anodes would look (deformation and cracking) after forming and anode baking. If the anodes were acceptable in appearance, i.e. not chipped or cracked or otherwise damaged, a number of such anodes would be tested in a single electrolysis cell to see if thermal shock cracking would be a problem.

Approximately sixty full size plant electrodes were produced and tested in a single electrolysis cell. No significant problems were found and there was no obvious thermal shock cracking despite the higher CTE. Anode butts were weighed and the average butt weight was 147 lbs compared to the regular anode butt weight of 146 lbs.

These positive results provided the incentive to move to larger scale plant trial but there was a concern that the low fines level made the anodes very sensitive to small pitch level changes. Thus, a further experiment was carried out.

EXAMPLE 4

Additional lab experiments were undertaken at a fines level of 27% and 30%. From this work, the 30% fines shot coke anodes appeared to give the best results. A plant trial was then undertaken to select the optimum pitch level and to make sure that anodes could be produced successfully on a larger scale with minimal scrap rates.

The properties of the shot coke anodes baking were better than expected. Anodes were produced at 3 pitch levels and the optimum level appeared to be 14.4%. This was 1.4% lower than the optimum pitch level of standard production anodes used in a representative commercial smelting process. This represents a substantial potential cost saving for the smelter since pitch is significantly more expensive than calcined petroleum coke.

Anode densities were also better than expected. The average density of the 14.4% pitch anodes was 1.598 g/cc compared to a typical density of 1.555 g/cc. A sustained density increase of this magnitude would allow the commercial smelting process to increase anode life in the electrolysis cells.

No unusual problems were reported.

The results from this Example 4 warranted a larger scale plant trial where anode and cell performance would be monitored closely to determined the full potential of the anode produced by the method of this invention.

These shot coke anodes were utilized in a commercial aluminum smelting process or pots

EXAMPLE 5

In a larger scale plant trial 710 full scale anodes were produced and tested in 4 closely monitored cells.

The shot coke anodes were used to run the four cells through at least 3 full anode cycles. Thus, each cell completely changes out a set of shot coke anodes 3 times. This gives the cell more chance to reach steady state conditions and performance with the different anode quality.

No thermal shock cracking or anode burn-offs occurred.

Although there has been hereinabove described a specific electrode useful for molten salt electrolysis of aluminum oxide to aluminum in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A method of making a carbon electrode, suitable for use as an anode in an aluminum reduction cell, which comprises mixing an aggregate of different size fractions, comprising a mixture of particulate shot coke and a particulate carbonaceous material other than shot coke with coal tar pitch or combination pitch at an elevated temperature to form a paste, and said paste comprises from about 80 to about 90%, by weight, of said aggregate and from about 10 to about 20%, by weight, of said coal tar pitch or combination pitch wherein said aggregate comprises from about 5 to 90%, by weight, shot coke; forming said paste into a solid body; and baking said solid body at an elevated temperature to form said carbon electrode.

2. The method of claim 1 wherein said shot coke comprises from about 10 to 50%, by weight, of said aggregate.

3. The method of claim 1 wherein said carbonaceous material is selected from the group consisting of sponge, and coal tar pitch cokes, and recycled carbon anode remnants or butts.

4. The method of claim 1 wherein said aggregate wherein said aggregate comprises from about 5 to 60% of coarse particles, 10 to 50% fine particles and from 0 to 30% butts.

5. The method of claim 4 wherein said coarse particles comprise from 25 to 75%, by weight, of shot coke.

6. The method of claim 4 wherein said fine particles comprise from 25 to 75%, by weight of shot coke.

7. The method of claim 1 wherein said solid body is subject to compressing or vibrating to form a green anode prior to baking.

8. The method of claim 1 wherein said solid body is baked at a temperature of above 1000° Centigrade.

9. A method of making a carbon anode for use in an aluminum reduction cell, in which aluminum oxide is reduced to molten aluminum metal at an elevated temperature, which comprises:

(a) mixing an aggregate comprising a mixture of particulate shot coke, prepared by screening and milling to provide a particulate mixture comprising at least 10%, by weight and a particulate carbonaceous material other than shot coke, and recycled carbon anode remnants or butts, with coal tar or combination pitches at an elevated temperature to form a paste wherein said aggregate comprises a combination of coarse, and fine particles and said particulate shot coke comprises a majority of said coarse particles, and said paste comprises from about 80 to about 90%, by weight, of said aggregate and from about 10 to about 20%, by weight, of said coal tar or combination pitches;

(b) forming said paste into a solid body; (c) subjecting said solid body to compression or vibration to form a green anode; and (d) baking said green anode at an elevated temperature of greater then 1000° Centigrade to form said carbon electrode.

10. The product of claim 1.

11. The product of claim 9.

12. A carbon electrode, suitable for use as an anode in an aluminum reduction cell, which comprises (a) an aggregate comprising a mixture of particulate shot coke and a particulate carbonaceous material other than shot coke, and (b) a coal tar pitch or combination pitch binder, wherein said aggregate comprises a combination of butts, coarse, and fine particles and said particulate shot coke comprises a majority of said fine particulates.

13. A method for producing aluminum by the molten salt electrolysis of aluminum oxide which comprises electrolyzing aluminum oxide dissolved in a molten salt at an elevated temperature by passing a direct current through an anode to a cathode disposed in said molten salt wherein said anode is the product of claim 1.

14. A method of making a carbon electrode, suitable for use as an anode in an aluminum reduction cell, which comprises mixing an aggregate, comprising a mixture of particulate shot coke, and a particulate carbonaceous material other than shot coke with coal tar pitch or combination pitch at an elevated temperature to form a paste wherein said aggregate comprises a combination of butts, coarse and fine particles wherein said particulate shot coke comprises more than 5%, by weight, of said aggregate, and said paste comprises from about 80 to about 90%, by weight, of said aggregate and from about 10 to about 20%, by weight, of said coal tar pitch or combination pitch; forming said paste into a solid body; and baking said solid body at an elevated temperature to form said carbon electrode.

* * * * *